US012111143B2

(12) United States Patent
Monti

(10) Patent No.: US 12,111,143 B2
(45) Date of Patent: Oct. 8, 2024

(54) SIMULATED AMMUNITION FOR FIREARMS

(71) Applicant: HAPTECH, INC., New Orleans, LA (US)

(72) Inventor: Kyle Monti, Luling, LA (US)

(73) Assignee: Haptech, Inc., New Orleans, LA (US)

( * ) Notice: Subject to any disclaimer, the term of this patent is extended or adjusted under 35 U.S.C. 154(b) by 20 days.

(21) Appl. No.: 18/138,810

(22) Filed: Apr. 25, 2023

(65) Prior Publication Data

US 2023/0341216 A1 Oct. 26, 2023

Related U.S. Application Data

(60) Provisional application No. 63/335,096, filed on Apr. 26, 2022.

(51) Int. Cl.
*F42B 8/08* (2006.01)

(52) U.S. Cl.
CPC ..... *F42B 8/08* (2013.01)

(58) Field of Classification Search
CPC ..... F42B 8/00; F42B 8/08
USPC ..... 273/348; 235/404; 434/21
See application file for complete search history.

(56) References Cited

U.S. PATENT DOCUMENTS 1,645,881 A * 10/1927 Strong ..... F41A 33/02 362/310
3,471,945 A * 10/1969 Fleury ..... H03K 17/292 434/21
4,830,617 A * 5/1989 Hancox ..... F41A 33/02 434/21
5,488,795 A * 2/1996 Sweat ..... F41A 33/02 362/112
5,685,106 A * 11/1997 Shoham ..... F41G 1/35 42/116
5,909,951 A * 6/1999 Johnsen ..... F41A 33/02 362/113
6,151,788 A * 11/2000 Cox ..... G01B 11/27 33/286

(Continued)

FOREIGN PATENT DOCUMENTS

CN 105300172 A 2/2016
WO 2009025891 A2 2/2009

OTHER PUBLICATIONS

International Search Report issued in App. No. PCT/US2023/19706, mailing date Jul. 19, 2023, 7 pages.

*Primary Examiner* — Joshua E Freeman
(74) *Attorney, Agent, or Firm* — Jason P. Mueller; FisherBroyles, LLP

(57) ABSTRACT

A simulated round of ammunition is configured so that it can be inserted into an actual or simulated firearm just like a regular live round of ammunition. The simulated round of ammunition includes elements that enable the simulated round of ammunition to generate a haptic effect that mimics the forces one would feel when firing a regular round of live ammunition. The simulated round of ammunition can include a linear motor, a voice coil or some other similar device which can cause a movable member to move in response to application of electric power. Movements of the movable member are used to generate the haptic effect. In some instances, the movable member may be configured to impact a mechanical stop to help generate the haptic effect.

20 Claims, 3 Drawing Sheets

(56) References Cited

U.S. PATENT DOCUMENTS

| | | | | |
|---|---|---|---|---|
| 6,216,381 | B1 * | 4/2001 | Strand | F42B 8/02 42/113 |
| 6,631,580 | B2 * | 10/2003 | Iafrate | F41A 33/02 42/134 |
| 9,170,079 | B2 * | 10/2015 | Moore | F42B 12/42 |
| 11,585,636 | B2 * | 2/2023 | Oliver | G09B 9/003 |
| 2002/0129536 | A1 * | 9/2002 | Iafrate | F41A 33/02 42/134 |
| 2010/0173686 | A1 * | 7/2010 | Grant | F41A 33/06 463/2 |
| 2019/0301843 | A1 * | 10/2019 | Hammond | F42B 8/00 |
| 2021/0215450 | A1 * | 7/2021 | Monti | A63F 13/285 |
| 2022/0364817 | A1 * | 11/2022 | Chambers | F41A 17/063 |

* cited by examiner

SIMULATED AMMUNITION FOR FIREARMS

This application claims priority to U.S. Provisional Patent Application No. 63/335,096, filed Apr. 26, 2022, the entire contents of each of which are incorporated herein by reference.

BACKGROUND

The present disclosure relates to simulated ammunition devices that can be inserted into an actual firearm designed to fire live ammunition or a simulated firearm capable of firing simulated ammunition. A round of simulated ammunition includes elements configured to generate a haptic effect that simulates the forces that would be generated by a regular live round of ammunition when a regular live round of ammunition is fired. Thus, a round of simulated ammunition can be used in connection with firearm training to give a user the realistic feeling of firing a firearm without using actual live rounds of ammunition while still using the real weapon system or a simulated weapon system designed to closely replicate a real weapon system. This can improve user, instructor, and spectator safety while reducing the costs of firearm training and at the same time improve the authenticity and effectiveness of the training.

BRIEF DESCRIPTION OF DRAWINGS

Various aspects and features of the present disclosure are described herein with reference to the drawings. Like numbers refer to like, but not necessarily the same or identical, elements throughout.

DESCRIPTION OF EMBODIMENTS

Figure 1:
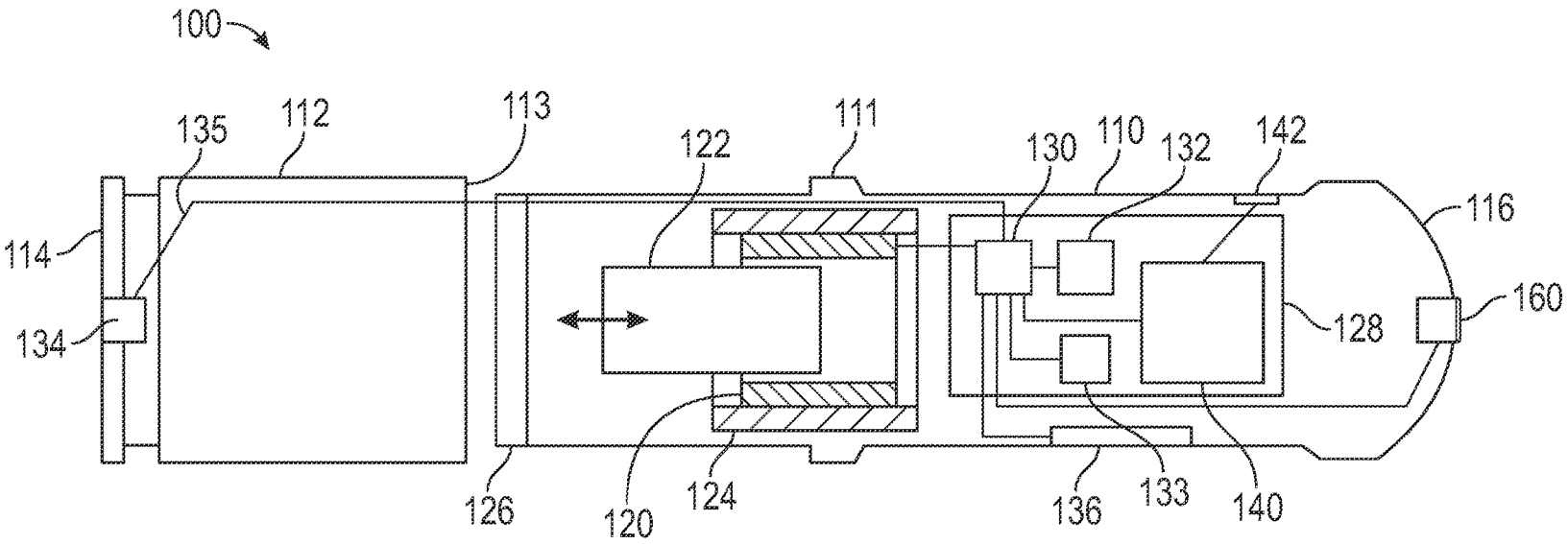
FIG. 1 is a partial cross-sectional, exploded view of a simulated round of ammunition.

A simulated round of ammunition is configured so that it can be inserted into a regular firearm just like a regular round of live ammunition. In some embodiments, the simulated round of ammunition will have generally the same weight and weight distribution as a regular round of ammunition such that when the simulated round of ammunition is loaded in a firearm, the firearm will have the same feel as a firearm loaded with a live round of ammunition. In other embodiments, the simulated round is configured so that it can be inserted into a simulated firearm that is designed to replicate the functionality of an actual firearm.

The simulated round of ammunition includes a mechanism that is configured to generate a haptic effect that simulates substantially the forces that would be produced when firing a regular live round of ammunition. The simulated round of ammunition can include a trigger unit that interacts with the regular firing mechanism of the firearm so that the simulated round of ammunition can be caused to generate the haptic effect in the same way one would cause a regular live round of ammunition to be fired.

The mechanism that generates a haptic effect could be any of multiple different types of mechanisms. In some instances, a linear motor could be used to cause a movable member of the linear motor to move to generate the haptic effect. Similarly, a solenoid or a voice coil arrangement could also be used instead of a linear motor. Other mechanisms capable of causing a moveable member to move to generate a haptic effect could also be used in a simulated round of ammunition. Also, the mechanism that causes a movable member to move could be unidirectional or bidirectional. Further, various springs or elastic elements and various dampeners or dampening mechanisms could be incorporated to provide various different types of haptic effects.

In some embodiments, only a single mechanism is used to generate a haptic effect to simulate firing of the actual or simulated firearm. In other embodiments, two or more mechanisms, each having movable members, could be used together to generate one or more haptic effects to simulate firing of the actual or simulated firearm.

Also, in some embodiments a first mechanism in the simulated round of ammunition could be used to generate a first haptic effect and a second mechanism could be used to generate a second haptic effect. Both haptic effects could be designed to simulate the firing of a round of ammunition. Alternatively, one haptic effect could simulate firing the round of ammunition and a second haptic effect could simulate some other action such as a misfire, an ammunition feed fault or failure, or an ammunition ejection fault or failure. Of course, other haptic effects designed to simulate other actual firearm operations are also possible.

Regardless of the mechanism, the movable member of the one or more mechanisms could be caused to impact a mechanical stop to help generate the haptic effect. The impact could be on a flat or an angled surface to cause varying forces to be generated by impact between the movable member and the mechanical stop. The mechanical stop could be attached to one or more of the mechanisms used to help generate a haptic effect. The mechanical stop could also be attached to a fixed or moveable portion of the firearm structure used to generate a haptic effect.

U.S. patent application Ser. No. 14/951,961, which issued as U.S. Pat. No. 10,852,093, discloses various ways that a linear motor could be used to generate haptic effects that simulate the firing of a firearm. The disclosure of that application and patent are incorporated herein by reference in their entirety.

The following discussion will focus on an example of a simulated round of ammunition that could be used in connection with an actual or simulated M320 Grenade Launcher. The M320 Grenade Launcher is the designation of the US Military's currently deployed single-shot 40 mm grenade launcher system. It can be attached under the barrel and forward of the magazine of a separate rifle, or it can be used dismounted with a stock attached as a stand-alone model. The regular rounds of ammunition that are used in an M320 Grenade Launcher include at least high explosive rounds, smoke generating rounds, illumination rounds, and precision-guided mini missiles such as the "Pike" missile designed by Raytheon. The regular M320 rounds can be designed to be lethal or non-lethal. Each of the different types of rounds generate different forces when fired. A simulated round of ammunition that is used with an M320 Grenade Launcher could simulate the forces generated when firing only one of the different types of actual rounds. Alternatively, a simulated round of ammunition for the M320 Grenade Launcher could be capable of selectively simulating the forces generated by firing of each of the different types of rounds.

Figure 2:
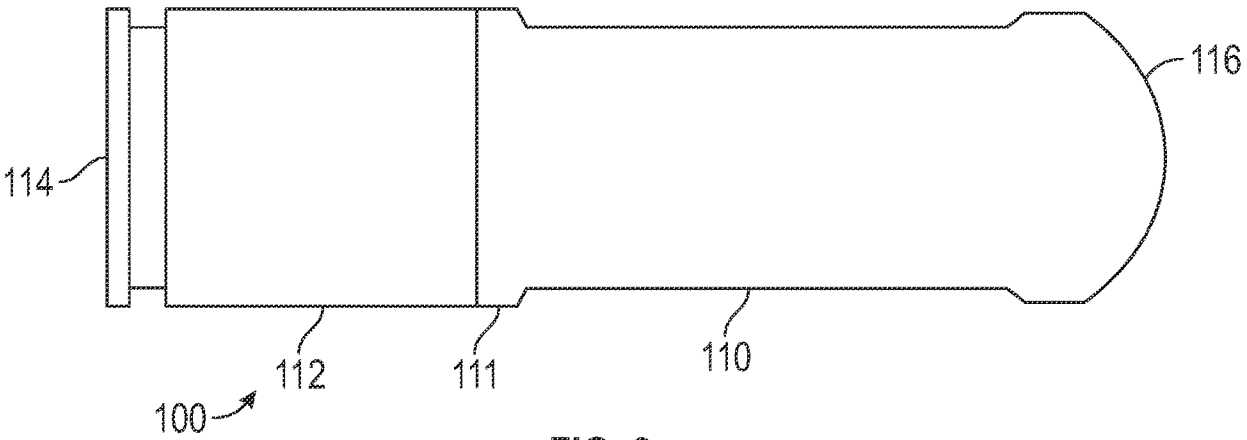
FIG. 2 is a side view of the simulated round of ammunition of FIG. 1 after it has been fully assembled.

FIG. 1 is a partial cross-sectional, exploded view of a simulated round of ammunition 100 for the M320 Grenade Launcher. FIG. 2 illustrates the same simulated round of ammunition 100 after the two halves of the housing of the simulated round of ammunition have been assembled together.

The housing of the simulated round of ammunition 100 includes a front half 110 and a back half 112. The back half 112 is configured to slide over the rear portion of the front half 110 until the front edge 113 of the back half 112 of the housing contacts a shoulder 111 on the front half 110 of the housing. The two halves 110/112 can then be affixed to one another using screws, bolts, pins, a bayonet mounting arrangement, spring-loaded projections and corresponding apertures, crimping, adhesives or any other affixation arrangement.

In the embodiment illustrated in FIGS. 1 and 2, a voice coil arrangement that includes a wire coil 120 and a magnetic movable member 122 is used to generate the haptic effect. Electrical power applied to the wire coil 120 causes the wire coil 120 to generate a magnetic field that interacts with the magnetic field of the magnetic movable member 122 to cause the magnetic movable member 122 to move. In some instances, simply causing the magnetic movable member 122 to move may be sufficient to generate a haptic effect that simulates firing a live round of ammunition. In other instances, the movable member 122 may be driven to impact a mechanical stop 126 to help generate the haptic effect.

The mechanical stop 126 can be formed of a non-metallic or non-electrically conductive material. In that instance, when the magnetic movable member 122 is driven into the mechanical stop there will be no forces that slow the magnetic movable member 122 before it impacts the mechanical stop.

In other instances, the mechanical stop can be formed of a metallic material, such as aluminum or copper, which is electrically conductive. In those instances, movement of the magnetic movable member 122 towards the mechanical stop 126 will induce an electrical current in the metallic mechanical stop 126. The induced current will generate a magnetic field which opposes the movement of the magnetic movable member 122, thereby slowing the magnetic movable member before it actually contacts the mechanical stop. The material type of the mechanical stop and the thickness and elasticity of the mechanical stop 126 can all be selectively varied to help produce a desired haptic effect. In some embodiments, the mechanical stop 126 may be a replaceable element, where one type of mechanical stop 126 can be replaced with a different type of mechanical stop 126 when one wishes to generate a different haptic effect.

In the embodiment illustrated in FIG. 1, the magnetic movable member 122 essentially contacts the mechanical stop 126 square on. In alternate embodiments, the portion of the magnetic movable member 122 that contacts the mechanical stop 126 could have varying profiles. Also, the surface of the mechanical stop 126 that contacts the magnetic movable member 122 could be angled or have different shapes or profiles. All of these elements can be selectively varied to achieve a desired haptic effect.

The wire coil 120 can be energized with varying amounts of electrical power to cause different types of movements of the magnetic movable member 122. The polarity of the applied power can be switched to cause the magnetic movable member 122 to move in different directions or to cause the magnetic movable member 122 to speed up or slow down. The profile or waveform of the applied electrical power also can be selectively varied to achieve desired haptic effects. Further, various power modulation techniques such as pulse width modulation can be used both to achieve a desired haptic effect and also to reduce the consumption of electrical power.

Although not illustrated in FIG. 1, in some embodiments a spring element or a dampening element may be configured to interact with the magnetic movable member 122 to control movement of the magnet movable member 122.

In some embodiments, a magnetic shield 124 formed of a material having specific desired magnetic permeability can be located around the exterior of the wire coil 120. The magnetic shield 124 can be used to focus or increase the forces of the magnetic field generated by the wire coil 120 and that is used to cause the magnetic movable member 122 to move. The magnetic shield can be formed, for example, of "MuMetal®", which is a nickel-iron soft ferromagnetic alloy with very high permeability. Other similar materials having high permeability could also be used for the magnetic shield 124.

The simulated round of ammunition 100 also includes an electronics module 128 mounted on the front half 110 of the housing. In the illustrated embodiment, the electronics module 128 includes a controller 130, a wireless transceiver 132, one or more inertial sensors 133 and a power source 140. In alternate embodiments, the electronics module 128 could include a variety of additional elements. Also, in some embodiments, not all of the features illustrated in FIG. 1 could be included in the electronics module 128. Thus, the depiction in FIG. 1 should in no way be considered limiting.

The power module 140 could include any type of power storage device or devices. The power storage devices can include conventional batteries, solid state batteries, capacitors, super capacitors, and other similar electrical power storage devices. The power source 140 can be re-charged via a charging port 142 located on an exterior of the housing 110. Although FIG. 1 depicts the charging port 142 mounted on a sidewall of the front half of the housing 110, in alternate embodiments the charging port 142 could be located in various other locations on the housing. The charging port 142 could include electrical contacts in a typical electrical socket arrangement. Alternatively, the charging port 142 could be configured as an inductive charging port and utilize an inductive charging element such as a tuned coil for inductive charging, such as that enabled by Qi, the open interface standard for wireless power transfer.

One or more inertial sensors 133 may be provided as part of the electronics module 128. The inertial sensors 133 could include one or more accelerometers, inclinometers, gyroscopes, magnetometers, piezoelectric sensors, inertial measurement units (IMU), thermostats, tilt sensors, current sensors (those measuring and optimizing power drain), magnetic field sensors such as anisotropic magnetoresistive (AMR) permalloy sensors, and various other devices which are configured to detect and report on characteristics, movements, and orientations of the simulated round of ammunition 100. While FIG. 1 shows the inertial sensor(s) 133 being part of the electronics module 128, one or more inertial sensors could be mounted at various locations on the housing. In some instances, the inertial sensor(s) 133 could report the orientation of the housing at the time the simulated round of ammunition 100 is fired. Also, the inertial sensor(s) 133 could report on movements of the simulated round of ammunition 100 that were caused or induced by the haptic effect generated when the simulated round of ammunition is caused to fire.

The wireless transceiver 132 could be any sort of wireless transceiver including a Bluetooth transceiver, a WiFi transceiver, a cellular transceiver, or other forms of radio transceivers. In some embodiments, rather than being a transceiver, the electronics module 128 could include only a wireless receiver or only a wireless transmitter. The wireless transceiver 132 allows signals to be communicated to and from the controller 130.

In some instances, information could be reported by the controller 130 via the wireless transceiver 132 to an external device which is monitoring the operations of the simulated round of ammunition 100. For example, the controller 130 could report information to an external monitoring device that is indicative of how many times the simulated round of ammunition has been fired, when the firing occurred, the movements that occurred when the simulated round of ammunition was fired, the orientation of the simulated round of ammunition when the round was fired, as well as various other items of information. The controller 130 could also report on device status, such as the amount of charge remaining in the power source 140, the type of haptic effect the simulated round of ammunition is currently configured to generate, as well as various other device condition parameters.

The wireless transceiver 132 may also allow an external device to control or selectively alter how the simulated round of ammunition performs. This can include controlling the type of haptic effect the simulated round of ammunition provides when fired. For example, an external device could send control signals to the controller 130 via the wireless transceiver 132 to switch the simulated round of ammunition from producing a first type of haptic effect that simulates a first type of ammunition to producing a second type of haptic effect that simulates a second type of ammunition.

A user interface 136 that is operationally coupled to the controller 130 may also be mounted on the housing. The user interface 136 could take the form of buttons, switches, a keypad or other user-operable devices to communicate control information to the controller 130. Although FIG. 1 illustrates the user interface 136 mounted on a sidewall of the front half 110 of the housing, the user interface 136 could be mounted on other portions of the simulated round of ammunition 100. Also, in some embodiments, it may be necessary to separate the front half 110 of the housing from the rear half 112 of the housing to access and operate the user interface 136.

The user interface 136 could be used to instruct the controller to take various actions such as switching among different haptic effects. Also, the user interface could report various items of information to the user, such as what haptic effect the simulated round of ammunition 100 is presently configured to provide, information about the amount of power remaining in the power source 140, as well as various items of historical information about past operations of the simulated round of ammunition 100.

A trigger unit 134 is located on the end face 114 of the rear half 112 of the housing. The trigger unit 134 is configured to interact with the firing mechanism of the firearm into which the simulated round of ammunition 100 has been loaded. For example, the trigger unit 134 could be a switch that is triggered by impact from a firing pin of the firearm. The trigger unit 134 sends a trigger signal to the controller 130 via a trigger line 135 when the user of the firearm triggers the firearm using the regular firing mechanism of the firearm. The controller 130 then causes a haptic effect to be generated when the trigger signal is received from the trigger unit 134.

In alternate embodiments, the trigger unit could be configured differently. Instead of a typical mechanical switch, the trigger unit 134 could use a capacitive touch sensor, a hall effect sensor, or optical elements that are designed to determine when the firing mechanism of the firearm has been operated by the user. Also, the switch of the trigger unit 134 may be located behind a plate that actually interacts with a firing pin or some other type of firing mechanism of a firearm. The plate that covers the switch could be a replaceable unit that can be configured differently depending on the configuration of the firearm. For example, the plate's thickness could determine the timing when trigger unit 134 actuates.

Figure 3:
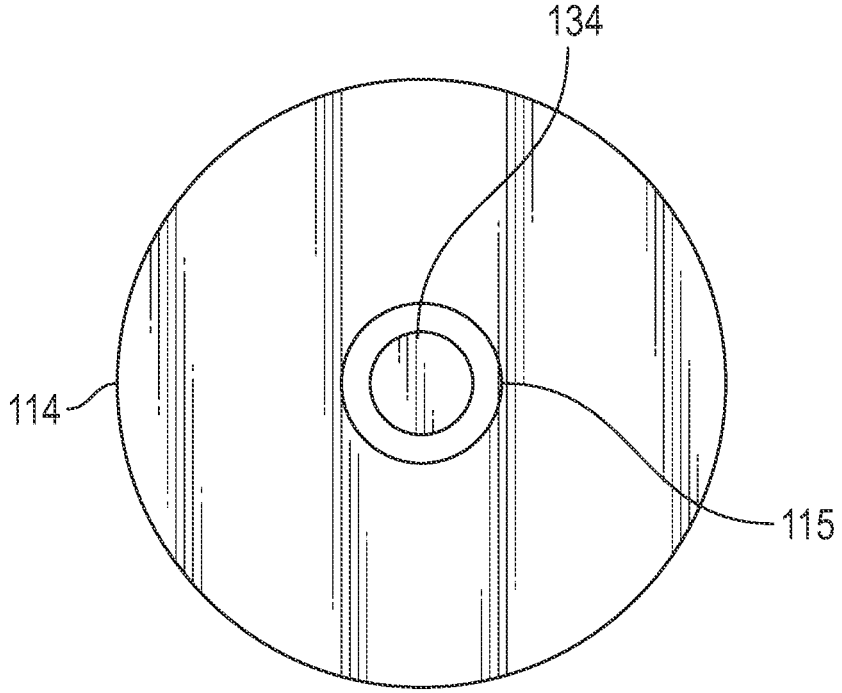
FIG. 3 is a back view of a back end of the simulated round of ammunition of FIGS. 1 and 2.

FIG. 3 illustrates the rear end 114 of the rear half 112 of the housing of a simulated firearm 100. In some embodiments, the trigger unit 134 may be mounted in a recessed portion 115 of the rear end 114 of the housing. In this embodiment, the trigger unit 134 is mounted in the center of the rear end 114 of the housing. In alternate embodiments, the trigger unit 143 could be located at various other positions that are designed to interact with the firing mechanism of a firearm.

The simulated round of ammunition 100 may also include a laser module 160 that emits laser light when the simulated round of ammunition 100 is fired—in other words, when the trigger unit 134 generates a trigger signal. The laser module 160 may be configured to emit laser light in the direction that an actual real round of ammunition would be fired out of the firearm. Thus, the laser module 160 may be located at the leading edge or front end 116 of the simulated round of ammunition so that the laser light emitted by the laser module 160 travels down the barrel of the firearm in the same direction that an actual round of ammunition would be fired. The laser light can then be detected by various sensors to determine how the firearm was aimed when the simulated round of ammunition was fired.

Figure 4:
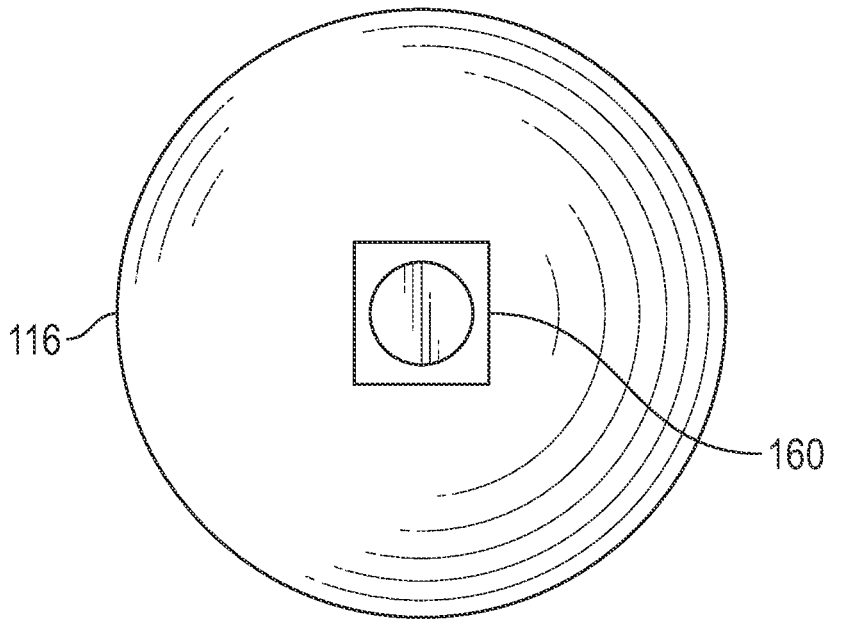
FIG. 4 is a front view of the front end of the simulated round of ammunition of FIGS. 1 and 2.

FIG. 4 illustrates the front end 116 of the simulated round of ammunition 100. The laser module 160 is located at the center of the front end of the simulated round of ammunition 100 so that laser light can be emitted down the center of the barrel of the firearm in which the simulated round of ammunition is located.

Figure 5:
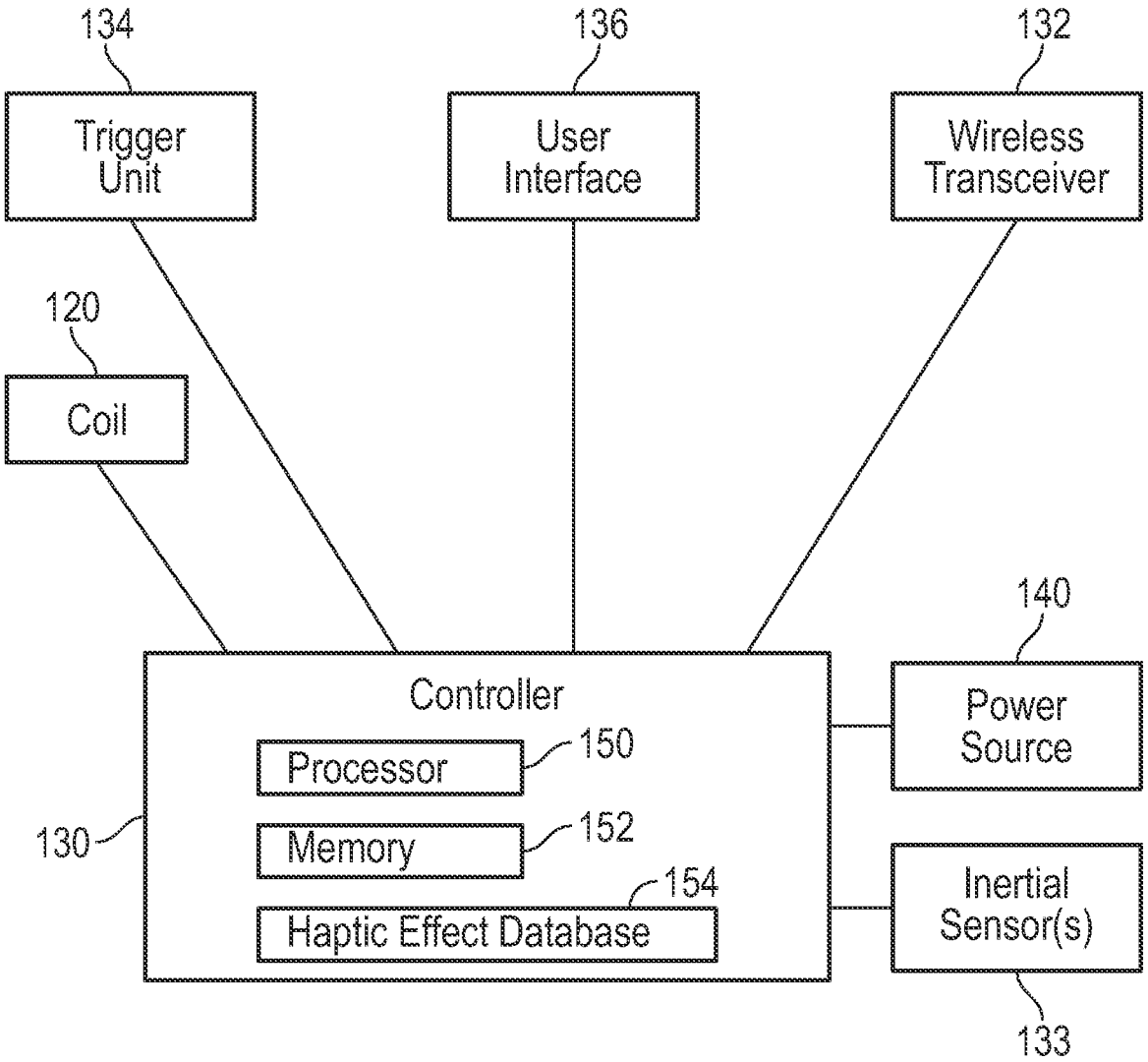
FIG. 5 is a diagram illustrating the major electrically operated elements of a simulated round of ammunition.

FIG. 5 provides a block diagram of the major electrical elements of the simulated round of ammunition. Of course, alternate embodiments need not have all the items appearing in FIG. 5, and some embodiments may include additional electrical elements not depicted in FIG. 5. Thus, FIG. 5 should in no way be considered limiting.

As shown in FIG. 5, the electrical elements include the controller 130, which may include a processor 150, a memory 152, and a separate haptic effect database 154. The memory 152 can be used to store various items of information as well as computer programming code that is used by the processor 150 to operate the simulated round of ammunition 100. The controller 130 can also include a haptic effect database 154 that stores information used by the processor 150 to generate different haptic effects. This can include information about the waveforms of different electrical signals the processor 150 can apply to the wire coil 120 to generate different haptic effects.

In some embodiments, the haptic effect database 154 can be programmed with information about different haptic effects when the simulated round of ammunition is first constructed. Also, it may be possible to download information about new haptic effects into the haptic effect database 154 via the wireless transceiver 132 after the simulated round of ammunition 100 has been manufactured and is already in use.

As illustrated in FIG. 5, the controller 130 is operatively connected to the wire coil 120, the trigger module 134, the user interface 136, the wireless transceiver 132, the power source 140 and the inertial sensor(s) 133. The connections between these elements and the controller can be wired or wireless connections. For example, the trigger unit 134 may include a wireless transmitter that generates a trigger signal when the firearm is fired. That wireless trigger signal can be delivered to the controller 130 via the wireless transceiver 132 connected to the controller 130. This would eliminate the need to run a wire from the trigger unit 134 to the controller 130, potentially simplifying assembly and disassembly of the simulated round of ammunition 100.

Some embodiments of a simulated round of ammunition may be configured such that a user must take a specific action or actions between firing events. For example, once the user has "fired" a simulated round of ammunition, the user may be required to move the simulated round of ammunition, and thus the actual or simulated firearm in which the simulated round of ammunition is loaded, in a predetermined way before the controller will cause another firing event. The predetermined motion could be tilting the simulated round of ammunition in a predetermined way, and that action on the part of the user could be sensed by one or more motion or inertial sensors included in the simulated round of ammunition. Such requirements could be imposed as a way to prevent cheating and to ensure a user is actually operating the simulated round of ammunition in an intended way.

For example, after "firing" a simulated round of ammunition, the user may be required to briefly tilt the front of the simulated round of ammunition downward before the user is able to again fire the simulated round of ammunition. This would require that the user downwardly tilt the front of the actual or simulated firearm in which the simulated round of ammunition is loaded between shots. The downward tilting of the simulated round of ammunition would be sensed by an onboard inertial sensor which communications information about such a tilting action to the controller. The controller would prevent the simulated round of ammunition from being re-fired until after appropriate signals have been received from the inertial sensor indicating that the tilting action has occurred.

The foregoing provides an example of a simulated round of ammunition that is configured for use in connection with a M320 Grenade Launcher. This is but one example. Simulated rounds of ammunition could also be configured for use in a wide variety of other types of firearms. The design details of the simulated rounds of ammunition for use in other firearms would vary depending on the configuration of the other firearms. For example, the location and type of trigger unit would vary depending on the firing mechanism of the firearm. Thus, the design details to the foregoing example should in no way be considered limiting.

A simulated round of ammunition can be used in an actual or simulated firearm as part of partial or total simulated firearm training, and also as part of simulated game play. In either case, the training or game play could include augmented or virtual reality components, where the user of the firearm is being presented with an augmented or virtual reality view during training/game play. In such cases, information reported from sensors or the controller of the simulated round of ammunition may be communicated to the elements responsible for generating the augmented or virtual reality view seen by the user. For example, inertial sensor data from the simulated round of ammunition could be communicated to the elements responsible for generating the augmented or virtual reality view so that the movements of the firearm illustrated in the augmented or virtual reality view closely match the movements sensed by the inertial sensors in the simulated round of ammunition. This helps to provide a more accurate augmented or virtual reality view to the user.

Also, information reported by the controller or sensors of the simulated round of ammunition could be used by the elements responsible for a simulated round of firearm training or simulated game play to help control how the training or game play proceeds. For example, information reported by inertial sensors of the round of simulated ammunition could indicate the inclination angle at which the user is holding the firearm. This information could be used by the elements controlling training or game play to determine what occurs when the user "fires" the firearm. As another example, if the controller of the simulated round of ammunition indicates that the user has already expended all available ammunition initially loaded into the firearm, and the user attempts to again fire the firearm, the elements controlling the training or game play will not allow the user to actually take another shot. Of course, there are a great many other actions that could be modified or controlled during simulated firearm training or game play based on information reported from the simulated round of ammunition.

Moreover, the augmented or virtual reality view presented to the user could change based on operational conditions of the simulated round of ammunition, and/or based on what has transpired during a training simulation or game play. For example, if a simulated round of ammunition is fired, the firing event can be communicated to the elements responsible for generating and providing an augmented or virtual reality view to the user. Once the firing event occurs, the appearance of the simulated round of ammunition (and/or the simulated firearm in which the simulated round of ammunition is loaded) could change within the augmented or virtual reality view to reflect the fact that the firing event occurred. This would allow the user to easily distinguish between an unfired and a fired round of ammunition.

Similarly, other items of information communicated from a simulated round of ammunition to the elements responsible for generating the augmented or virtual reality view could result in different simulated rounds of ammunition appearing differently in the augmented or virtual reality view. For example, each simulated round of ammunition could communicate information about the type of ammunition the round is supposed to represent. Each different type of simulated round of ammunition could then appear differently, depending on type, in the augmented or virtual reality view presented to the user.

The foregoing discussion focused on the use of a simulated round of ammunition in an actual firearm. However, it is also possible that a simulated round of ammunition could be used in connection with a simulated firearm as well. This could arise in multiple contexts.

In one use, a simulated firearm could include a firing mechanism that closely resembles the firing mechanism of an actual firearm. In that case, a simulated round of ammunition could inserted into and used in the simulated firearm. The simulated round of ammunition could be triggered to "fire" in much the same way that the simulated round of ammunition could be "fired" by an actual firearm.

In another use, the simulated round of ammunition could be configured to generate a trigger signal or be "fired" by some sort of firing mechanism other than or in addition to the firing mechanism of an actual firearm. In this case, the simulated round of ammunition could be inserted into and used in a simulated firearm, with the simulated round of ammunition responding to the alternate firing mechanism provided by the simulated firearm.

In still other instances, a first type of actual weapons system designed to fire a particular type of ammunition can be incorporated into or attached to second type of actual firearm. As an example, an M320 Grenade Launcher as described above can be attached to an M16A4 rifle or an M4 carbine. Under these circumstances, an actual M320 Grenade Launcher could be attached to a simulated M4 carbine, and a simulated round of M320 ammunition could then be used in the M320 Grenade Launcher to provide haptic effects, even though the M320 Grenade Launcher is actually attached to and used in conjunction with a simulated M4 carbine.

In the example provided immediately above, where an actual M320 Grenade Launcher is attached to a simulated M4 carbine, a simulated round of M320 ammunition loaded in the actual M320 Grenade Launcher might not be responsible for generating a haptic effect when the user desires to fire the M320 Grenade Launcher. Instead, when the user triggers the M320 Grenade Launcher to "fire" the simulated round of ammunition loaded in the M320 Grenade Launcher, the simulated round of M320 ammunition may communicate a firing signal to a controller of the simulated M4 carbine. The controller of the simulated M4 carbine might then cause a haptic mechanism mounted on the simulated M4 carbine to generate a haptic effect that simulates firing of the M320 Grenade Launcher. Of course, this same sort of situation could occur when the M320 Grenade Launcher is itself a simulated model attached to the simulated M4 carbine.

Also, it is possible that operations of a simulated round of ammunition loaded into an actual or simulated firearm could respond to external control signals. For example, if a round of simulated ammunition is loaded into an actual or simulated firearm that is being used in a training exercise or for virtual game play, external control signals from the system running the training exercise or the virtual game play may send wireless control signals to the controller of the simulated round of ammunition or the controller of a weapon system simulator to control various aspects of how the simulated round of ammunition acts. For example, such control signals could dictate that the simulated round of ammunition can only be fired once every twenty seconds to accurately mimic how long it takes to reload the firearm under real life conditions. Of course, a large number of other operational aspects of a simulated round of ammunition could also be controlled by external control signals.

While the embodiments of this disclosure are described with reference to various implementations and exploitations, it will be understood that these embodiments are illustrative and that the scope of the embodiments of the present disclosure is not limited to them. Many variations, modifications, additions, and improvements are possible. The above description should therefore not be construed as limiting, but merely as exemplifications of particular embodiments.

What is claimed is:

1. A simulated round of ammunition configured to be used in an actual or simulated firearm, comprising:

a housing having an outer shape that corresponds to an outer shape of an actual round of ammunition;

a wire coil mounted in the housing and configured to generate a magnetic field when electrical power is applied to the wire coil;

a movable member comprising a magnetic element that is movably mounted on the housing relative to the wire coil, wherein when electrical power is applied to the wire coil, a magnetic field generated by the wire coil causes the movable member to move relative to the wire coil;

an electrical power source mounted in the housing; and a controller that causes electrical power from the electrical power source to be applied to the wire coil to cause the movable member to move such that movement of the movable member generates a haptic effect that simulates firing of an actual round of ammunition.

2. The simulated round of ammunition of claim 1, further comprising a trigger unit mounted on the housing and operatively coupled to the controller, wherein the trigger unit is configured to generate a trigger signal when a firing mechanism of an actual or simulated firearm interacts with the trigger unit.

3. The simulated round of ammunition of claim 2, wherein the trigger unit comprises a sensor mounted on an end of the housing and configured to generate the trigger signal when a firing pin of a firearm contacts the sensor.

4. The simulated round of ammunition of claim 2, wherein the trigger unit comprises a sensor that is configured to generate a trigger signal when a firing mechanism of a simulated firearm interacts with the sensor.

5. The simulated round of ammunition of claim 4, wherein the firing mechanism of the simulated firearm is different from a firing mechanism of an actual firearm.

6. The simulated round of ammunition of claim 1, further comprising a mechanical stop located on the housing such that the movable member can contact the mechanical stop to help generate the haptic effect.

7. The simulated round of ammunition of claim 6, wherein the mechanical stop comprises an electrically conductive metal.

8. The simulated round of ammunition of claim 1, further comprising a sheath that surrounds the wire coil, wherein the sheath is formed of a material that provides magnetic shielding.

9. The simulated round of ammunition of claim 1, further comprising a magnetic shield having high permeability that surrounds the wire coil.

10. The simulated round of ammunition of claim 1, wherein the power source comprises a plurality of capacitors.

11. The simulated round of ammunition of claim 1, further comprising a charging port mounted on the housing and functionally coupled to the power source such that an external source of electrical power can be used to re-charge the power source via the charging port.

12. The simulated round of ammunition of claim 1, wherein the controller is configured to be coupled to a user interface that can be used to instruct the controller to take certain actions.

13. The simulated round of ammunition of claim 12, wherein the controller is configured to receive control signals from the user interface that instruct the controller to apply electrical power having one of a plurality of predetermined waveforms to the wire coil to cause the movable member to generate one of a corresponding plurality of predetermined haptic effects.

14. The simulated round of ammunition of claim 13, further comprising a wireless receiver mounted on the housing and coupled to the controller, wherein the wireless receiver is configured to receive control signals from the user interface and to deliver those control signals to the controller.

15. The simulated round of ammunition of claim 1, further comprising a wireless transmitter coupled to the controller, wherein the wireless transmitter transmits reporting signals incorporating operational information provided by the controller.

16. The simulated round of ammunition of claim 1, further comprising at least one inertial sensor mounted on the housing and configured to detect an orientation of the housing, wherein the inertial sensor is operatively coupled to the controller and wherein the inertial sensor reports signals to the controller that are indicative of an orientation of the housing.

17. The simulated round of ammunition of claim 16, wherein the controller is configured to control aspects of the generation of a haptic effect based on signals previously received from the inertial sensor.

18. The simulated round of ammunition of claim 16, wherein the inertial sensor is also configured to detect motion of the housing when a haptic effect is generated and to report signals to the controller that are indicative of the detected motion.

19. The simulated round of ammunition of claim 18, wherein the controller is configured to control aspects of the generation of a haptic effect based on signals previously received from the inertial sensor.

20. The simulated round of ammunition of claim 1, further comprising a laser emitter that is operatively coupled to the controller and that is configured to emit laser radiation in a direction that the simulated round of ammunition would be fired if the simulated round of ammunition were a live round of ammunition.

* * * * *